United States Patent [19]

Aschauer

[11] Patent Number: 4,605,376

[45] Date of Patent: Aug. 12, 1986

[54] MARINE JET PROPULSION UNIT

[76] Inventor: George R. Aschauer, 720 Florence Ave., Racine, Wis. 53402

[21] Appl. No.: 692,510

[22] Filed: Jan. 18, 1985

[51] Int. Cl.[4] ..... B63H 11/10

[52] U.S. Cl. ..... 440/38; 440/41; 440/42; 440/96; 60/221; 60/222; 415/5; 417/320

[58] Field of Search ..... 440/38, 40–43, 440/47, 95–97, 90; 60/221, 222; 415/5; 417/320

[56] References Cited

U.S. PATENT DOCUMENTS

| | | | |
|---|---|---|---|
| 696,666 | 4/1902 | Berg | 440/47 |
| 2,404,493 | 7/1946 | Hait et al. | 440/96 |
| 2,467,641 | 4/1949 | West | 417/320 X |
| 3,183,878 | 5/1965 | Aschauer | 440/38 |
| 3,376,843 | 4/1968 | Wilson | 440/96 |
| 3,782,114 | 1/1974 | Broes | 440/38 |
| 4,493,658 | 1/1985 | Hildebrand | 440/90 X |

*Primary Examiner*—Sherman D. Basinger

*Attorney, Agent, or Firm*—James E. Nilles; Thomas F. Kirby

[57] ABSTRACT

The marine jet propulsion unit of this invention, in preferred form, has a pair of laterally adjacent blade carriers, each having a vertical outer surface movable in a horizontal orbit and to which blades are fixed that project edgewise outwardly. Each blade has a surface facing in the direction of its orbital movement that is concavely curved along its height. The two blade carriers, at opposite sides of a fore-and-aft extending vertical plane of symmetry, are driven in opposite orbital directions such that each has a driving portion remote from the plane of symmetry that moves rearward in an acceleration channel and has an opposite forwardly moving portion adjacent to the plane wherein its blades are interleaved with those of the other. Water entering a forward intake is guided in two streams, one to the front end of each acceleration channel, and the rear end of each acceleration channel is communicated with a discharging outlet nozzle.

16 Claims, 16 Drawing Figures

MARINE JET PROPULSION UNIT

FIELD OF THE INVENTION

This invention relates to hydraulic jet propulsion units for water craft, of the type having a forward water intake, a rearward discharging outlet, and impeller means whereby water entering the intake is pumped rearward to the outlet to produce a reaction force by which the craft is propelled; and the invention is more particularly concerned with a marine reaction propulsion unit that has impeller means comprising at least one orbitally moving blade carrier which so cooperates with a housing of the unit as to impart to pumped water a steady and almost purely rearward acceleration, with small and gradual changes in static pressure head.

BACKGROUND OF THE PRIOR ART

In a marine jet propulsion unit, water is taken in through an inlet in the bottom of the hull and is accelerated rearwardly in the unit for discharge at the stern. The craft is propelled forward by reaction to the rearward acceleration of the mass of pumped water passing through the unit, and therefore the propulsion force depends upon the rate of flow of pumped water per unit time and the rate of change of momentum imparted to the pumped water in the course of its flow from the intake to the discharging outlet. It will be apparent that if the water, in passing through the unit, acquires a certain amount of kinetic energy from the impeller, and then gives up a part of that kinetic energy during subsequent passage through straightening vanes or other flow redirecting means, the reaction forces imposed upon the flow redirecting means may oppose the propulsion reaction force and correspondingly reduce the propulsion efficiency of the unit. In like manner the water entering the inlet may have a substantial ram velocity due to the forward speed of the craft, and if it gives up a part of that velocity before encountering the impeller, as by flow disturbance due to the impeller shaft or improper flow direction with respect to the first impeller blading, much of this ram benefit is lost. Ideally, therefore, the water passing through a marine jet propulsion unit should flow from intake to outlet in a straight, substantially nonturbulent and unswirling but steadily accelerated stream.

Water entering the inlet of a hydraulic jet propulsion unit is at atmospheric pressure, and it is discharged to atmospheric pressure at the outlet. Because of the limited atmospheric "push" at the intake, the rise in pressure along the flow path of the pumped water must be gradual and at a relatively small rate to avoid cavitation with its attendant high internal losses, low efficiency and reduction of component life. The art has understood for some years that if energy could be added to the pumped water in the form desired for propulsion—i.e., kinetic energy—with only a slight increase in pressure of the water between the intake and the outlet, the unit could operate at high speed without danger of cavitation and its degenerative effects.

Prior hydraulic jet propulsion units have almost invariably comprised propeller-like or turbine-like impellers which generated pressure largely as a function of their rotational speed and outside diameter. To avoid abrupt changes in pressure along the flow path of the pumped water these were often arranged to provide multiple stages, as disclosed for example in the applicant's prior U.S. Pat. No. 3,328,961 and No. 3,405,526.

Such an impeller induced a swirling flow that had to be straightened by fixed vanes downstream from each impeller stage, and it was obvious that a certain amount of energy was wasted in inducing the swirl and again in straightening the flow.

A proposed impeller intended to avoid these deficiencies, disclosed in the applicant's U.S. Pat. No. 3,183,878, comprised a generally conventional sliding vane pump that had its axis horizontal. Pumped water flowed upwardly and rearwardly from the intake to the pump housing along a gently curving path, and then flowed substantially straight rearwardly from the pump housing to the discharging outlet. In theory the unit disclosed in that patent provided for a nonswirling flow of pumped water. However, the centrifugally responsive radially sliding vanes of the pump rotor had to be confined within a cylindrical pump housing wall that was circumferentially continuous, and therefore the pumped water had to enter and leave the pump housing through ports in its cylindrical wall. If these ports were of substantial width, as measured parallel to the pump axis, they left little wall area to support the vanes as they passed across the ports and thus subjected local portions of the vanes to frictional wear that could result in destruction of the pump. Pump life could be prolonged by reducing the area of the ports, but at the cost of constricting the flow of water through each port, thus entailing an inevitably unsatisfactory compromise between operating efficiency and pump life. Another important disadvantage of a sliding vane impeller is that it is likely to be destroyed by particles of foreign matter in the fluid passed through it, whereas particulate material of one kind or another will inevitably be drawn into a marine jet propulsion unit from time to time unless it has a filter at its intake that sacrifices propulsion efficiency in favor of effective filtration.

As prior art that might be considered to have some pertinence to the present invention, reference can be made to U.S. Pat. No. 3,965,846 to Mihara, No. 745,732 to Little, and No. 3,292,899 to Egli.

Mihara and Little disclose impeller units comprising endless belts that move in laterally adjacent horizontal orbits and have laterally projecting blades. In both cases the impeller units generate propulsive force by their action on unconfined water outside the hull of the craft, rather than by acting upon a confined stream of water; hence these are not jet propulsion units but are more nearly related to paddle wheel propellers. Unconfined water acted upon by a paddle wheel tends to have substantial components of lateral flow which do not give rise to forward reaction forces that are useful for propulsion.

Egli discloses an energy transfer machine wherein an endless belt having laterally extending vanes has one straight stretch which passes through a housing, entering and leaving the housing through ingress and egress passages that are substantially sealed by the belts and vanes. Fluid moves through the housing from an inlet to an outlet that are respectively separate from the ingress and egress passages, and within the housing it zigzags across the path of the vanes, which are cambered to promote such transverse flow. Because the fluid flow path through the housing is a sinuous one, it is apparent that much of the energy transferred from the endless belt to the fluid is manifested as static pressure rather than as kinetic energy. Furthermore, the arrangement poses obvious problems with respect to the possibility of undesired issuance of fluid from the egress passage.

SUMMARY OF THE INVENTION

The general object of the present invention is to provide a hydraulic jet propulsion unit for watercraft that provides for a nearly straight and non-swirling flow of pumped water through the unit and for a small and gradual change in the static pressure of pumped water as it flows through the unit, to provide for high propulsion efficiency with substantially no likelihood of cavitation.

Another general object of this invention is to provide a reaction propulsion unit for marine craft having an impeller that comprises at least one orbitally moving blade carrier with blades that have surfaces which face in the direction of orbital motion, said blade carrier being so arranged that its blades move relatively rearwardly in an acceleration channel in a driving portion of their orbit and move relatively forwardly in a return channel in an opposite return portion of their orbit, and said unit being so arranged that water is conducted in a substantially straight or gently curving front to rear flow path from an intake to said acceleration channel, then through said acceleration channel wherein it is accelerated rearward by the driving portion of the blade carrier, and then from said acceleration channel to a discharging outlet, all without subjecting the water to substantially high changes in static pressure.

Another and more specific object of the invention is to provide a hydraulic jet propulsion unit of the character described wherein no inlet drive shaft is immersed in the flow of pumped water to disturb that flow, and wherein a relatively small entrained mass of liquid is present in the apparatus at any instant.

Another object of this invention, realized in preferred embodiments of it, is to provide a hydraulic jet propulsion unit having an impeller that comprises a pair of orbitally moving blade carriers and having a housing that cooperates with the blade carriers to provide a pair of acceleration channels, said unit being so arranged that water entering the housing is divided into two equal streams, each of which is directed into one of the acceleration channels to be accelerated rearward in it by a blade carrier moving in that channel, said unit being further so arranged that each stream enters its acceleration channel while moving in substantially the same direction as the portion of the blade carrier that the stream encounters, while that portion of the blade carrier moves into the stream of water in a manner to avoid cavitation.

It is also a specific but important object of the invention to provide a hydraulic jet unit of the character described that has substantially less tendency towards cavitation than prior such units, the unit being arranged to avoid high and abrupt changes in fluid velocity along the flow path of the pumped water and being further arranged to provide for a small return flow of pumped water and air forwardly from near the discharge outlet to the zone of lowest static pressure for overcoming any tendency towards cavitation that might occur.

It is also an object of this invention to provide a hydraulic jet propulsion unit which is compact, light in weight, efficient in operation and substantially unaffected by the presence of particulate matter in the water passing through it, and which is thus well adapted for installation in marine craft of a wide variety of types and configurations.

In general, these and other objects of the invention that will appear as the description proceeds are achieved in the marine reaction propulsion unit of this invention, comprising a housing having a forward water intake and a rearward discharging outlet, and driven impeller means whereby water entering said intake is accelerated rearward and expelled through said outlet to generate a forward propulsive reaction force. The reaction propulsion unit of this invention is characterized in that its impeller means comprises a blade carrier which moves in an orbit in one orbital direction and to which a plurality of substantially identical blades are fixed that are spaced apart at substantially regular intervals in said orbital direction, each said blade having a front surface which faces in said orbital direction. Preferably the front surface of each blade is concavely curved between a pair of opposite substantial straight edges of the blade that extend outward from the blade carrier orbit. The orbit of the blade carrier has a driving portion in which the blades move rearward and an opposite return portion.

The unit of this invention is further characterized in that its housing is formed to define an acceleration channel in which the blade carrier has its driving portion and wherein water is accelerated rearward by rearward movement of that driving portion, an inflow passage which leads from said intake means to the front end of the acceleration channel and an outlet passage which leads from the rear end of said acceleration channel to said outlet means. The housing also defines a return passage in which the blade carrier has its return portion and an air passage which at one end opens to the atmosphere and at its other end communicates with a rear end of the return passage.

BRIEF DESCRIPTION OF DRAWINGS

In the accompanying drawings, which illustrate what are now regarded as preferred embodiments of the invention.

DETAILED DESCRIPTION OF PREFERRED EMBODIMENTS OF THE INVENTION

Figure 1:
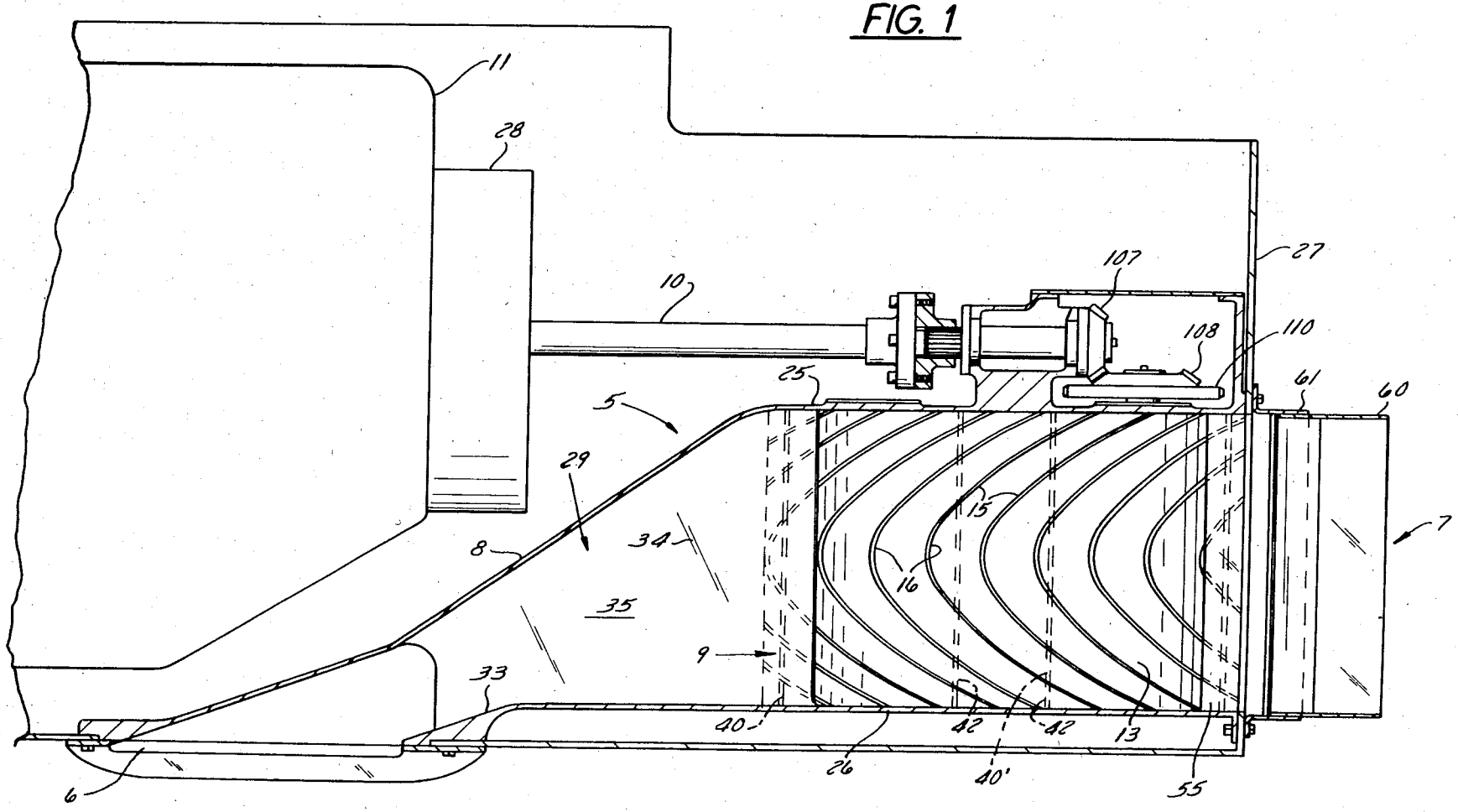
FIG. 1 is a fragmentary view in vertical section through a marine craft in which a hydraulic reaction propulsion unit of this invention is installed.

A marine craft propelled by a hydraulic jet propulsion unit 5 of this invention has a scoop-like water intake 6 at the bottom of its hull whereby water is taken into the unit from the sea, and such water, after being accelerated rearward in the unit, is discharged through an outlet 7 at the stern of the craft.

The reaction propulsion unit 5 comprises, in general, a housing 8 in which water flows rearward from the intake 6 to the outlet 7, impeller means 9 in the housing whereby the water is accelerated rearward, and drive means outside the housing which provides for rotatably driving the impeller means and which comprises a shaft 10 that may be driven from any suitable prime mover 11.

To minimize ram losses, the intake 6 has a low inlet angle, that is, it deflects water upwardly at a relatively shallow angle, thus minimizing intake flow separation. For further minimizing flow separation and the ram losses inherent in it, the intake 6, which is preferably rectangular or trapezoidal in plan view, is long in the direction of inflow relative to its width. The discharging outlet 7 can be either above or below the surface of the sea water without making any difference to propulsion efficiency.

Figure 8:
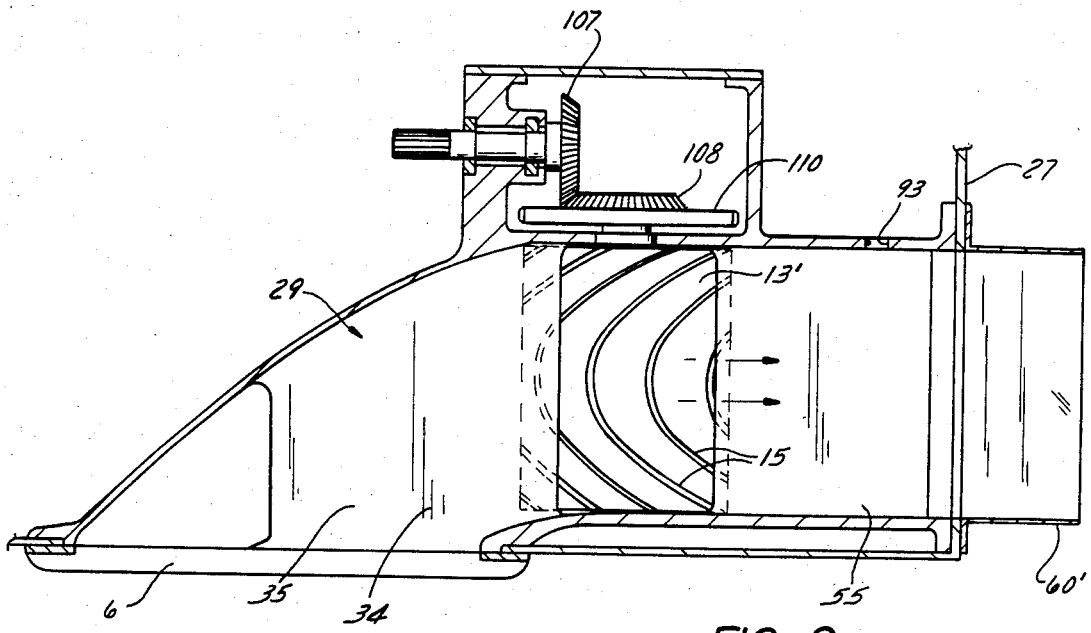
FIG. 8 is a view in vertical section of another embodiment of the propulsion unit of this invention.
Figure 9:
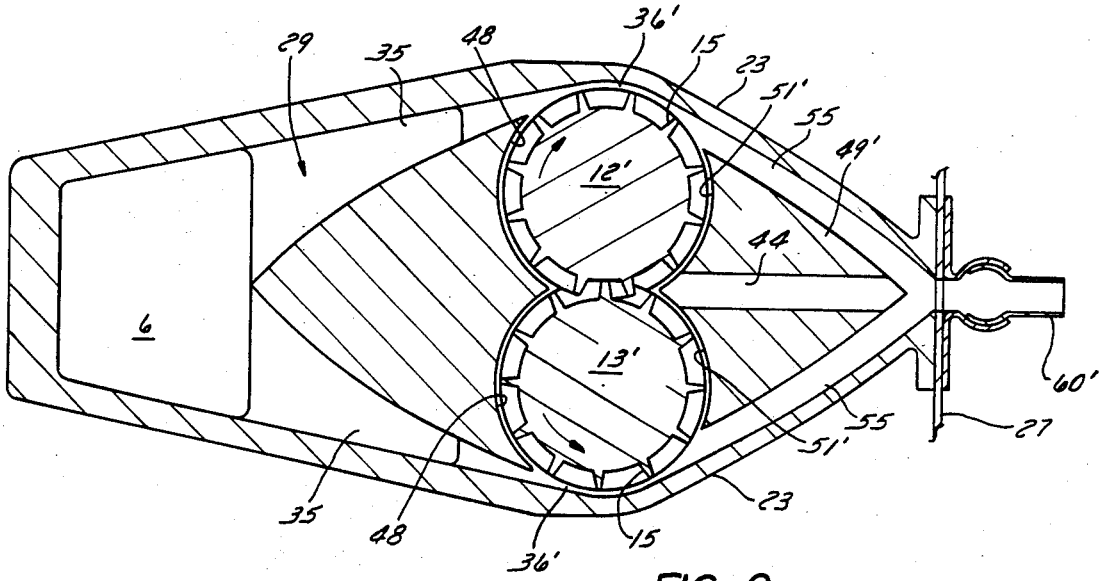
FIG. 9 is a view in horizontal section of the propulsion unit shown in FIG. 8.

In preferred embodiments of the jet unit of this invention the impeller means 9 comprises a pair of identical blade carriers 12, 13, each of which moves in a horizontal orbit and which are disposed laterally adjacent to one another, at opposite sides of a vertical plane of symmetry of the propulsion unit 5 that will usually coincide with a fore-and-aft extending plane of symmetry of the craft in which the unit is installed. As shown in FIGS. 1–7, each of the blade carriers 12, 13 can be in the nature of an endless belt, or as shown in FIGS. 8–9 each blade carrier 12', 13' can be in the form of a cylindrical rotor. In each case, each blade carrier has blades 15 which are spaced apart at regular intervals around its orbit and which have deeply concave front surfaces 16 that face in the direction of its orbital motion.

As each blade carrier 12, 13 moves orbitally, any given point on it moves in succession through four portions of its orbit, namely a driving portion, a rear transition portion, a return portion and a front transition portion; hence at any given instant the blade carrier itself can be regarded as having a driving portion 18, a rear transition portion 19, a return portion 20 and a front transition portion 21. The driving portion 18 of each blade carrier 12, 13, which is remote from the plane of symmetry and from the other blade carrier 13, 12, moves generally rearward and serves to impart rearward acceleration to water driven through the unit. The return portion 20, which is adjacent to the plane of symmetry, moves generally forward. The rear transition portion 19 moves generally laterally inwardly, towards the plane of symmetry, to carry a point on the blade carrier from the driving portion of the orbit to the return portion thereof; and the opposite front transition portion 21 moves generally laterally outwardly.

The housing 8 of the unit, which is symmetrical to the vertical plane of symmetry of the blade carriers, comprises a pair of opposite side walls 23 that extend along the full length of the unit from the front edge of the intake 6 to—or nearly to—the transom 27 of the craft; a top wall 25 that extends along the full length of the side walls; and a bottom wall 26 that extends rearwardly from the rear edge of the intake 6.

Figures 2, 3, 4:
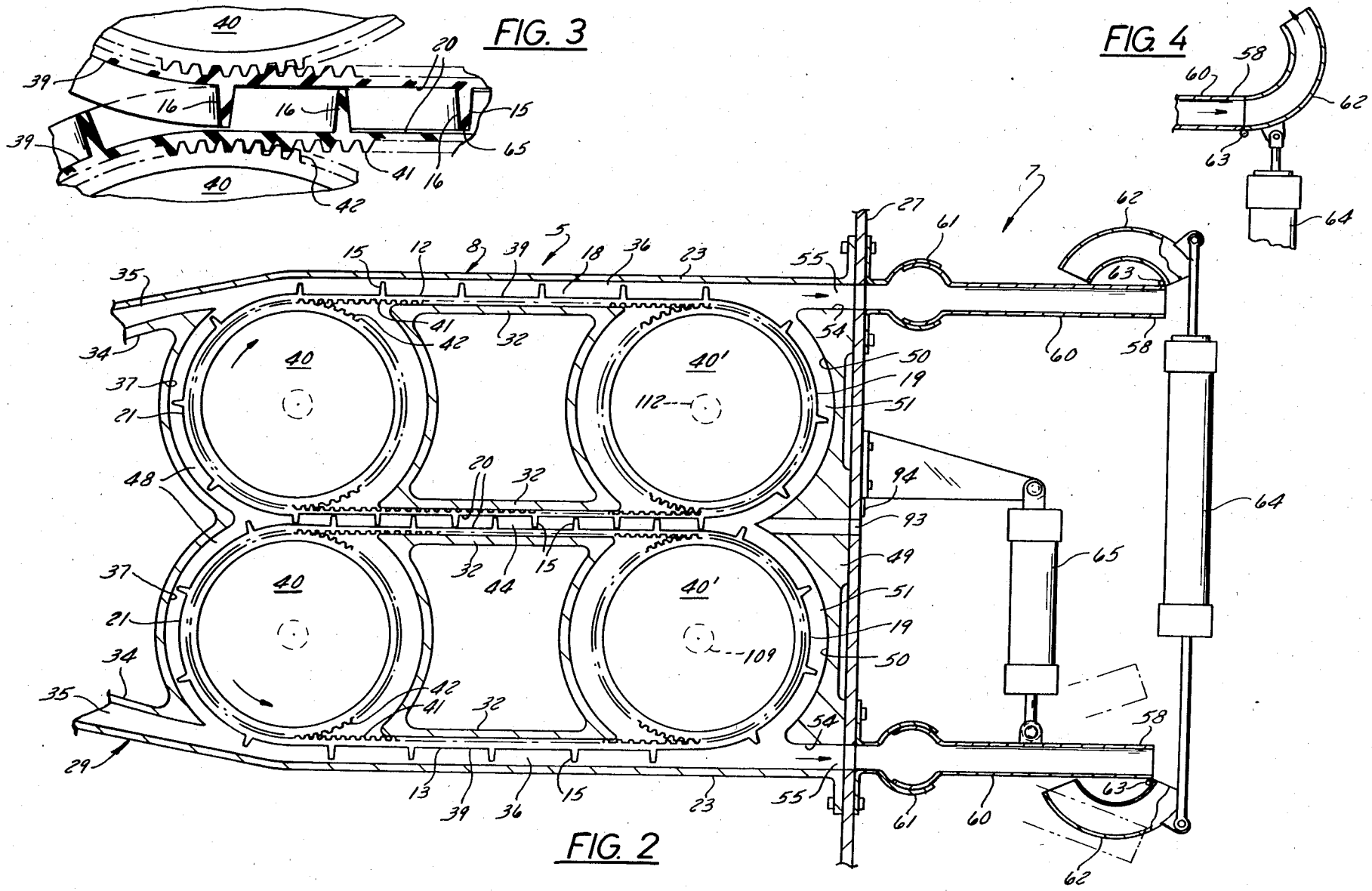
FIG. 2 is a view in horizontal section of the unit shown in FIG. 1.
FIG. 3 is a fragmentary view in horizontal section on an enlarged scale showing details of the connections of the endless blade carriers with their drivers.
FIG. 4 is a fragmentary view of one of the discharge outlets, shown in its condition for rearward propulsion.
Figure 5:
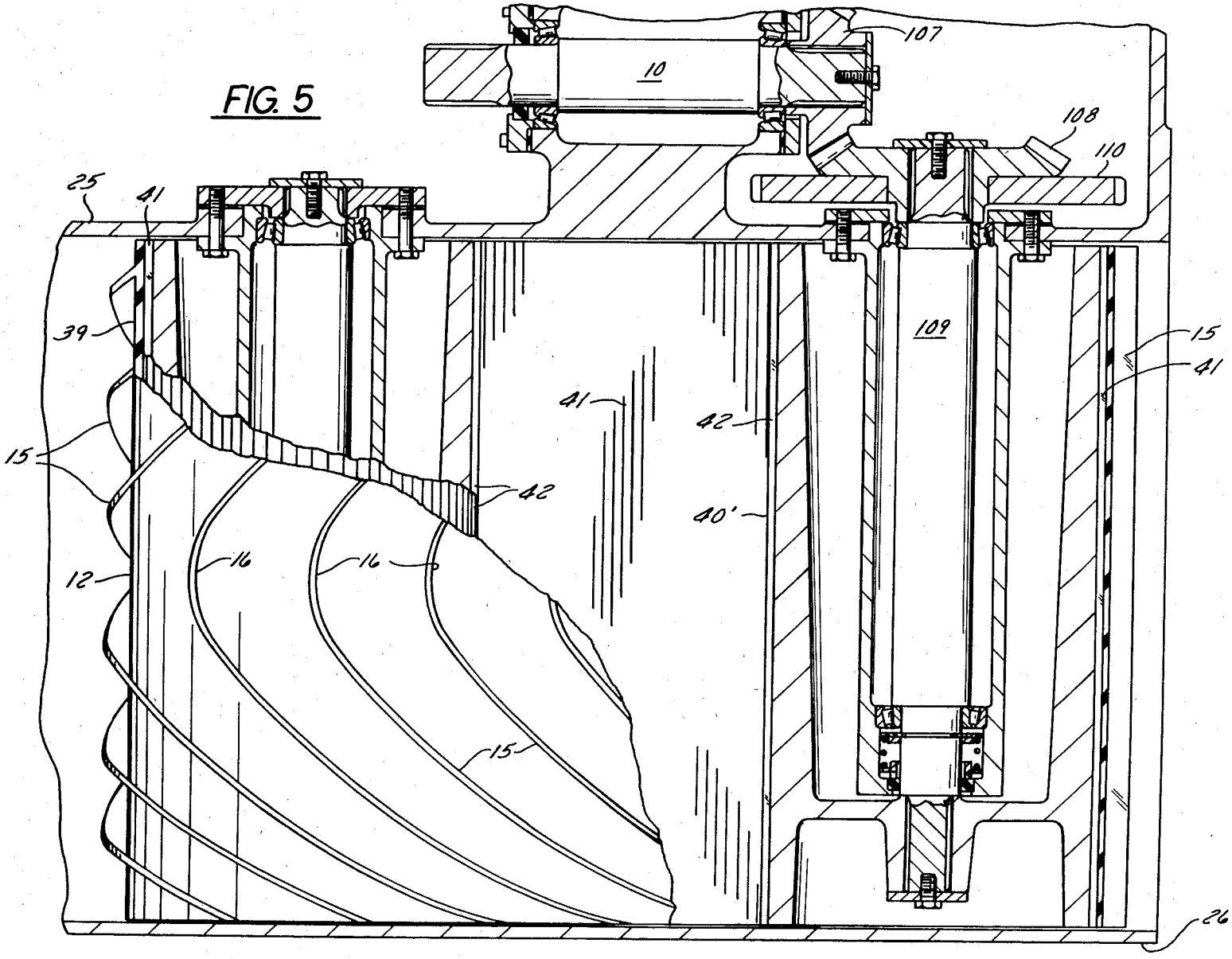
FIG. 5 is a view of one of the endless blade carriers in its relation to its drivers, the view being partly in elevation but with substantial portions shown broken away.
Figure 7:
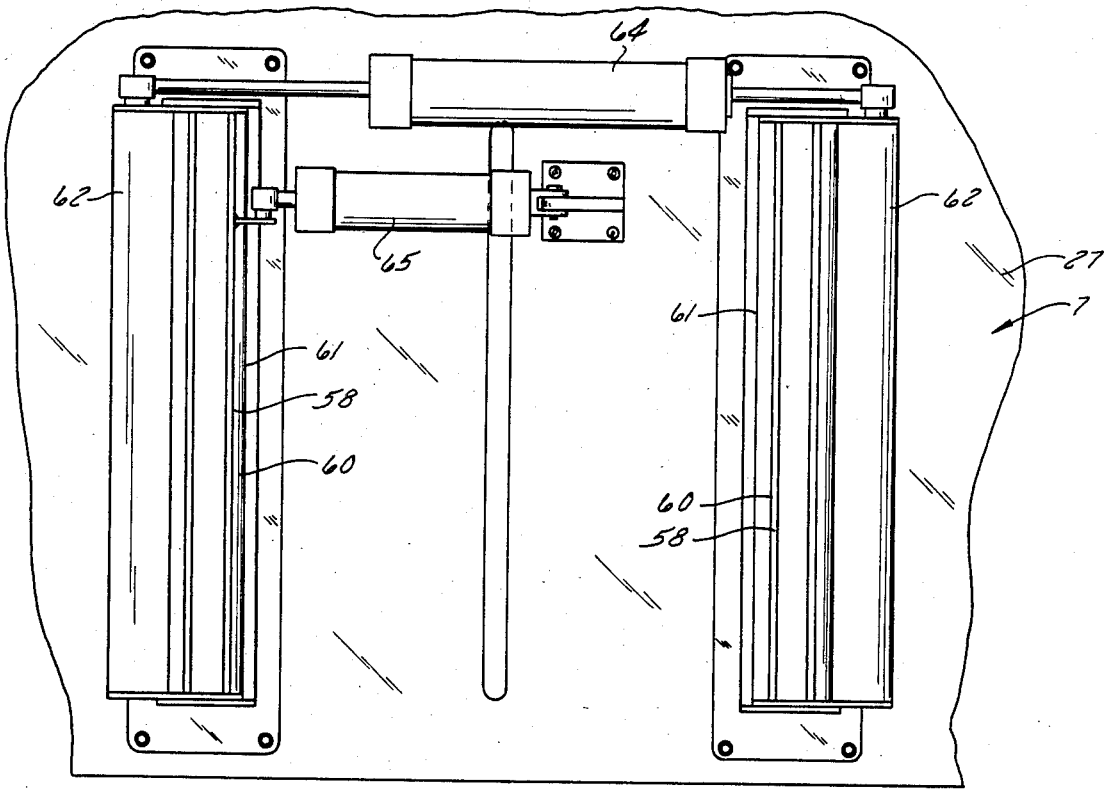
FIG. 7 is a fragmentary view in rear elevation, on an enlarged scale, of the marine craft shown in FIG. 6.

Inside the housing 8, sealed to its top and bottom walls, are certain island-like flow directing bodies which can be solid as shown in FIG. 9 but which are preferably of hollow construction as shown in FIG. 2. These bodies will comprise, in any case, a front flow-dividing body 29 which cooperates with the housing side walls 23 to conduct incoming water in two streams to the respective blade carrier driving portions 18. With a single intake 6, the flow-dividing body 29, in plan view, has the shape of a forwardly pointing arrowhead or a shield.

The top wall 25 of the housing slants upward and rearward from the front edge of the intake 6 to the rear portion of the flow dividing body 29, but the remainder of the top wall is substantially planar and horizontal. If the prime mover 11 is a reciprocating engine, its flywheel 28 can be conveniently located over the slanting front portion of the housing top wall.

The front edge of the bottom wall 26 of the housing defines the rear edge of the intake 6. For a short distance behind its front edge that wall has a rearwardly and upwardly inclined top surface portion, as at 33, which merges into a substantially flat and horizontal top surface along most of the length of the bottom wall. The relatively shallow inclination of the leading portion 33 of the bottom wall minimizes flow separation at and just behind the intake 6 and encourages a smooth flow of water upward and rearward through the intake.

The flow dividing body 29 as here shown has its more or less pointed front end at or slightly to the rear of the rear edge of the intake. Its side surfaces 34 cooperate with their laterally adjacent portions of the housing side walls 23 to define a pair of rearwardly diverging inflow passages 35 in the housing, each of which opens rearwardly into, and is substantially continuous with, an acceleration channel 36 in the housing in which one of the blade carriers 12, 13 has its driving portion 18. The flow dividing body 29 also has generally rearwardly facing surfaces 37 that define front transition passages 48, in each of which one of the blade carriers has its front transition portion 21.

Figure 6:
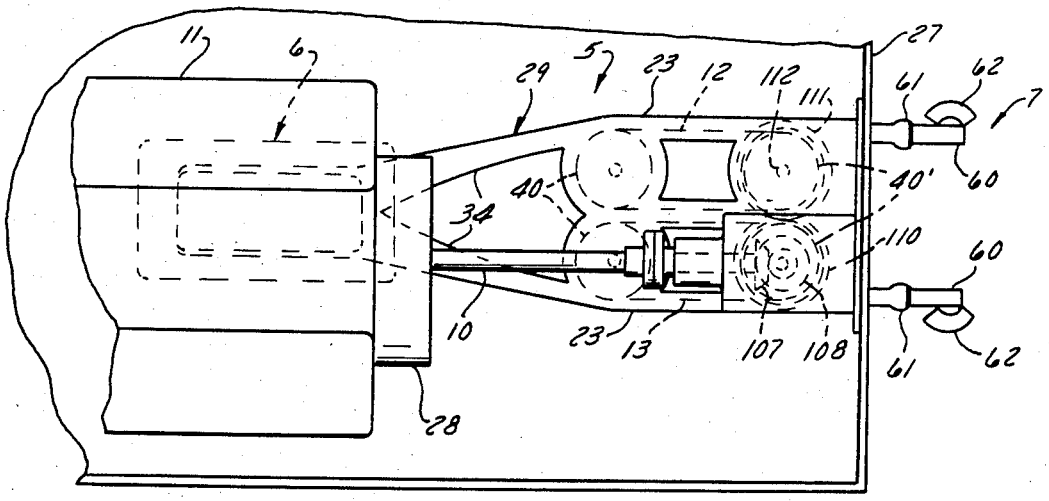
FIG. 6 is a more or less schematic plan view of the installation in a marine craft of the propulsion unit illustrated in FIGS. 1–5.

Each side wall 23 of the housing is in rearwardly convergent relationship to its adjacent side surface 34 of the flow dividing body 29, so that each inflow passage 35 tapers rearwardly in width, as best seen in FIG. 6. However, owing to the rearwardly divergent relationship of the inclined front portion of the top housing wall 25 and its opposing top surface portions of the bottom wall 26, each inflow passage 35 is of rearwardly increasing height. At every point along each inflow passage 35 the relationship of its width to its height is such that the cross-section area of the passage decreases gradually and steadily rearwardly along it, so that the water in it is gradually and steadily accelerated in its rearward flow. Each inflow passage 35 has a gradual curvature along its length whereby the stream deflected obliquely to one side by the flow dividing body 29 is brought to straight rearward flow at its entry to the acceleration channel 36.

As water flows from each inflow passage 35 into its communicating acceleration channel 36 it encounters one of the blade carriers 12, 13. As shown in FIGS. 1–6 and 16, each blade carrier 12, 13 comprises a wide edgewise vertical belt 39 of tough, elastomeric material with integrally formed blades 15 that project outwardly from its substantially flat outer surface. Each such endless blade carrier is trained around a pair of substantially cylindrical drums 40, 40' which have their axes upright and spaced apart in the fore-and-aft direction so that each blade carrier, as trained around its drums, is generally oval in plan view, with straight side stretches that comprise its driving portion 18 and its return portion 20.

The inner surface of each blade carrier belt is formed with straight ribs 41 that extend transversely to the width of the belt (i.e., vertically), spaced at regular intervals along it, and these ribs mesh with mating ridges 42 on the cylindrical surfaces of the drums 40 to provide a gear-like connection that prevents slippage between the drums and the blade carrier. The front drum 40 for each blade carrier can be an idler while the rear drum 40' is rotatably driven from the shaft 10 of the prime mover 11. In this case the driving shaft 10 extends horizontally rearwardly across the front drum 40 of one of the blade carrier belts and has on its rear end a bevel gear 107 that meshes with a bevel gear 108 which is fixed to the top of the shaft 109 of the driven drum 40' for that blade carrier belt. Also fixed to the top of that drum shaft 109, just below the driven bevel gear 108, is a gear 110 that meshes with a corresponding gear 111 on the shaft 112 of the other driven drum 40', so that the driving shaft 10, the bevel gear transmission 107, 108 and the synchronizing gears 110, 111 are outside the housing 8 of the unit and thus cause no disturbance to flow of water through the unit.

Because the rear drum 40' for each blade carrier is driven, the driving portion 18 of the blade carrier is under tension while its return portion 20 is slack.

Inside the housing of the unit, connected to the top and bottom walls 25 and 26, are a pair of intermediate bodies 32, each of which occupies the space between the two drums 40, 40' for a blade carrier and between the two straight stretches of the blade carrier that constitute its driving portion 18 and its return portion 20. Mainly each of those bodies 32 fills the space inside the orbit of a blade carrier belt to reduce the amount of entrained water in the unit. However, each also provides opposite flat surfaces along which the inner surface of the surrounding blade carrier belt is slidable in the straight stretches thereof and by which those straight stretches can be supported against inward bowing, although the driving stretches 18 normally have little tendency toward such bowing because they are under both lengthwise tension and lateral hydraulic pressure balance. The intermediate bodies 32 also cooperate with the housing side walls 23 to define the acceleration channels 36, and they cooperate with one another to define a return passage 44 for the return portions 20 of the blade carriers.

As best seen in FIGS. 2 and 3, the drums 40, 40' and the intermediate bodies 32 for the respective blade carriers are so arranged that the return portions 20 of the two blade carriers are parallel and so closely adjacent to one another that the blades 15 on each project outwardly to the outer surface of the belt 39 that comprises the other. The slack return portions 20 of the two blade carriers thus support each other. By their gear-like connections with the driving drums 40' the two blade carriers are so synchronized in their orbital movements that the blades 15 on the return portion 20 of each carrier are spaced at uniform lengthwise intervals from those on the other, so that the blades on the return portions of the two blade carriers can be said to be interleaved.

The flow dividing body 29 has a pair of arcuate rearwardly concave rear surfaces 37, one at each side of the plane of symmetry, each of which is curved concentrically to its rearwardly adjacent drum 40 and cooperates with the front transition portion 21 of its rearwardly adjacent blade carrier to define a front transition passage 48 that communicates the return passage 44 with an acceleration channel 36. In the rear of the housing, behind the blade carriers, is a rear body 49 that has a pair of arcuate forwardly concave front surfaces 50, one at each side of the plane of symmetry, each of which is curved concentrically to its forwardly adjacent drum 40' and cooperates with the rear transition portion 19 of its adjacent blade carrier to define a rear transition passage 51 that communicates an acceleration channel 36 with the return passage 44. The rear body 49 also has opposite side surfaces 54 which cooperate with the side walls 23 of the housing to define short outlet passages 55, each leading from the rear end of an acceleration channel 36 to the discharging outlet 7. Each rear transition passage 51 joins its acceleration channel 36 at the junction of that acceleration channel with its outlet passage 55.

The discharging outlet 7, which will normally be located behind the transom of the craft that carries the propulsion unit, comprises known means for deflecting the discharged water to provide for steering and reverse propulsion of the craft. In the embodiment of the invention illustrated in FIGS. 1–7, the discharging outlet comprises a pair of nozzles 60, each located rearwardly in line with one of the acceleration channels 36 and communicated with that acceleration channel through an outlet passage 55. Each nozzle 60 has a joint 61 that enables its rear end portion 58 to be swingable from side to side, as best seen in FIG. 2. An arcuate nozzle extension 62 for each nozzle, curved through somewhat more than 90°, has a hinged connection 63 to the rear end of its nozzle to be swingable between an inoperative position shown in FIG. 2 and an operative position shown in FIG. 4. In its inoperative position each nozzle extension 62 lies alongside its nozzle to be out of the flow of water issuing therefrom. In its operative position the arcuate nozzle extension 62 provides in effect a continuation of its nozzle whereby water issuing therefrom is deflected around to be discharged obliquely forwardly and thus exert a rearward reaction force upon the nozzle extension 62 that serves for braking or reverse propulsion of the craft. The hinged connection 63 for each nozzle extension 62 is at the laterally outer side of its nozzle, so that the nozzle extensions 62 swing towards one another in moving towards their operative positions. For swinging them in unison towards each of their positions, an extensible and retractable cylinder actuator 64 is connected between them. Preferably the actuator 64 is biased to an extended condition in which it holds the nozzle extensions 62 in their inoperative positions, and it is hydraulically actuatable to its retracted condition for braking and rearward propulsion of the craft.

Through the actuator 64 the rear end portions 58 of the nozzles are connected to swing left and right in unison about their joints 61. A hydraulic steering cylinder actuator 65, connected between the transom 27 and one of the nozzle portions 58, can therefore swing the two nozzle portions 58 from side to side for steering control.

It will be apparent that in the zone of communication of each inflow passage 35 with its acceleration channel 36, a rearwardly flowing stream of water meets blades 15 of a blade carrier that are moving orbitally at a higher velocity than that of the stream. As the blades 15 accelerate the water rearwardly, the forward reaction to that acceleration constitutes a propulsion force.

Simply stated, cavitation occurs when water at the impeller of a reaction propulsion unit is accelerated to such an extent that it moves downstream before incoming water can take its place. More specifically, pressure in a zone just upstream from the impeller falls to such a low value that water in that zone vaporizes, leaving gaps or cavities in the stream.

In the unit of the present invention several factors cooperate to prevent cavitation. For one thing, water flows through the unit along an unobstructed substantially straight or gently curving flow path that offers minimum resistance to flow of incoming water and does not induce abrupt accelerations or flow separations. Another important factor is that at the junction of the front transition passage 48 with the inflow passage 35, where those passages also join the acceleration channel 36, the orbit of the blade carrier merges with the flow of water in such a manner that each blade 15 moves substantially edgewise into the stream, tip first, so that the blade does not fully extend across the stream until it is moving bodily in a direction which substantially corresponds with that of the stream flow. As a blade moves orbitally from the front transition passage 48 into the acceleration channel 36, it has an increasing component of rearward velocity that is well suited for imparting a gradual rearward acceleration to the water that it is meeting. In this zone of convergence, if the rearward velocity of the blade is so much higher than that of water in its vicinity as to pose a threat of cavitation, water can readily flow around the tip of the blade to relieve the low pressure. However, owing to the edgewise tip-first movement of the blade into the stream of water, the blade tip increasingly approaches the housing side wall 23 as it moves rearward, and thus the flow path around the blade is increasingly constricted as the quantity of water in front of the blade is accelerated towards the velocity of the blade.

In the acceleration channel 36, the side wall 23 of the housing is spaced at such a distance from the opposing surface of the island-like medial body 32 that there can be a small clearance between the blade tips and that side wall. Thus water in the flow channel is for the most part compelled to move with the blades, but it can escape around a blade tip to the extent necessary for relief of an excessive difference between the pressures at the front and rear surfaces of the blade.

Figure 10:
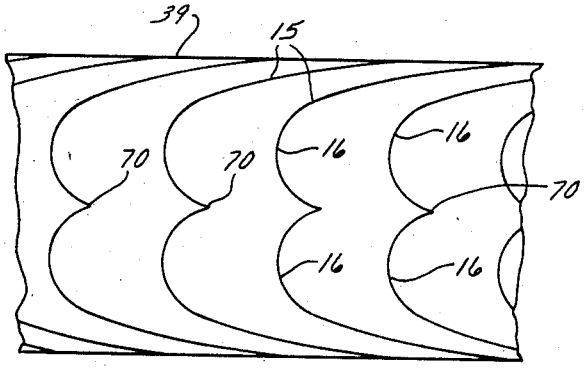
FIGS. 10–13 are fragmentary views in elevation of the blade carrier illustrating various blade configurations, the blade being shown in each case as viewed edge-on from its tip edge.
Figure 11:
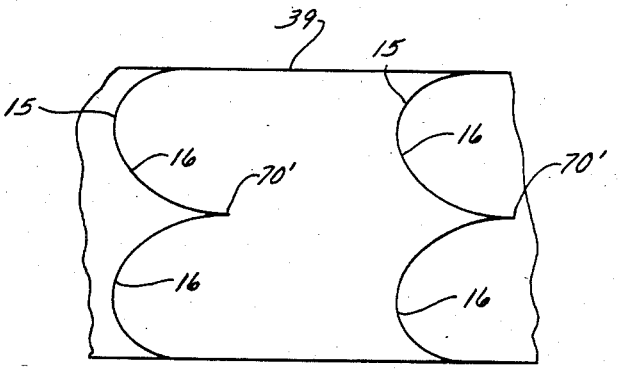
Figure 12:
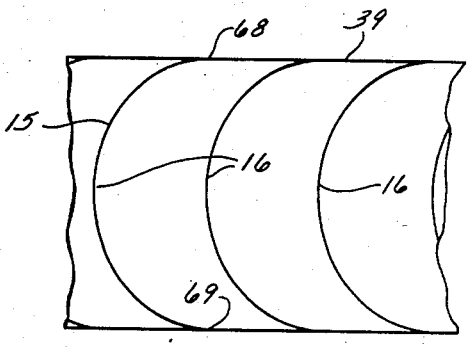
Figure 13:
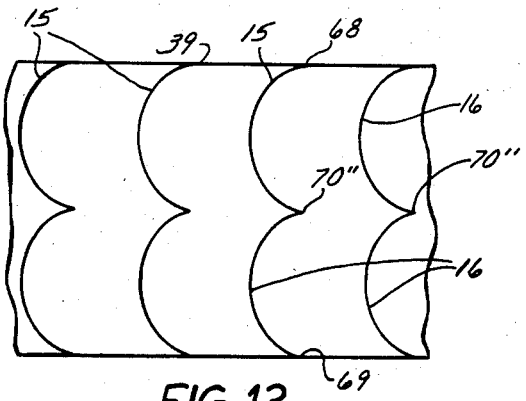

Another important factor contributing to the non-cavitating operation of the unit of this invention is the configuration of the blades 15, all of which are identical. In planform—i.e., as viewed in the orbital direction—each blade is substantially rectangular, with a straight tip edge 65 and with substantially straight top and bottom edges 68, 69 that are parallel, both being contained in a single vertical plane as well as extending horizontally parallel to one another. As viewed from its tip end, looking toward the belt portion 39, each blade is curved across its height to have a deeply concave front surface 16. As shown in FIG. 12, the blade can have a single curvature across its height, preferably parabolic, or, as shown in FIGS. 10, 11 and 13, it can have a double curvature across its height. With a double curvature, the two curved blade portions meet at a forwardly projecting crease-like junction 70 on a horizontal plane of blade symmetry midway between the horizontal planes that contain the top and bottom edges of the blade. Also, the top and bottom edges of a blade having double curvature can be located substantially forward of the crease-like junction 70, as shown in FIG. 11; or that junction 70' can project forwardly beyond the top and bottom edges, as shown in FIG. 11; or the junction 70'' of the two curved blade portions can be contained in the same vertical plane that contains the top and bottom edges, as shown in FIG. 13. In any case, the curvature of the blade provides convergent surfaces on it along which water engaged by the blade can slide rearwardly relative to it while being smoothly accelerated to the velocity of the blade, in contrast to the more or less abrupt impacting acceleration that a flat blade would impart to the water.

Each blade tapers in thickness towards its tip edge 64, being preferably of trapezoidal cross-section to constitute a cantilevered beam of constant strength.

An additional factor that tends to prevent cavitation is the return passage 44 in which the return portions 20 of the two blade carriers move forwardly. A certain amount of water tends to be diverted from the outlet passage 55 to the rear transition passage 51, whence it is carried forward in the return passage 44, from which it is returned to the inlet ends of the acceleration channels 36 by way of the front transition passages 48. Introduction of this recirculated water into the acceleration channels tends to raise static pressure in the zones where cavitation would otherwise be most likely to occur. No significant amount of energy is required to effect this recirculation because the water in the recirculation path comprising the transition passages 51 and 48 and the return passage 44 is moving from a higher pressure zone to a lower pressure zone.

The quantity of recirculated water is minimized and cavitation is further prevented by means of an air passage 93 in the housing which at one end has an inlet to the atmosphere that is well above the level of the water line of the craft and which at its other end communicates with the rear end of the return passage 44. As here shown, the air passage inlet is in the transom of the craft. Preferably a cover plate 94 is arranged to be moved to and from a position sealing off the air passage inlet from the atmosphere. When the craft is at a standstill or moving at low forward speed, the cover 94 can be kept closed and the above described recirculation of water can be relied upon to prevent cavitation. As the craft comes up to a speed at which water enters the intake 6 of the propulsion unit with a significant ram velocity, further acceleration of the craft requires an increase in the ratio between the forward speed of the craft and the velocity to which the water is accelerated by the impeller means 9. As water flows through the unit from the intake 6 to the outlet 7, the static pressure of the water remains nearly constant, near atmospheric pressure. At higher speeds, therefore, the unit is in effect trying to drive out more water than is coming into it. However, opening the cover 94 for the air passage allows air to be drawn into the stream of water being pumped through the unit, and the indrawn air thus compensates for the difference between the volume of water entering the intake 6 and the volume that the unit is simultaneously trying to expel through the outlet. The indrawn air thus maintains a static pressure all along the stream of water that is substantially equal to atmospheric pressure. In a sense the quantity of air drawn into the system is automatically controlled, since air tends to enter the stream of water only when—and to the extent that—the local static pressure of the water stream at the inlet to the acceleration channel falls below atmospheric pressure. It will be recognized that the principle here involved is analogous to that of a supercavitating propeller.

In the embodiment of the invention illustrated in FIGS. 8 and 9 each of the blade carriers 12', 13' is in the form of a substantially cylindrical drum which rotates on a fixed axis and to which identical blades 15 are affixed that project substantially radially at regular circumferential intervals around it. The blades 15 can have any one of the above described configurations. The two blade carriers are mounted in such laterally adjacent relationship that their blades move in orbits which have overlapping return portions in which the blades on each carrier are interleaved with those on the other and the tip of each blade on a carrier touches, or nearly touches, the cylindrical surface of the other carrier. The flow dividing body 29 again defines front transition passages 48 and inflow passages 35 which open into acceleration channels 36', but in this case each acceleration channel is of course curved along its length as seen in plan view (FIG. 9) in an arc concentric to its adjacent blade carrier. The housing has a rear body 49' in its interior which cooperates with the side walls 23 of the housing to define outlet passages 55 that curve rearwardly to a junction with one another at which they communicate with a single outlet nozzle 60'. The body 49' also defines rear transition passages 51' that communicate the respective outlet passages 55 with a return passage 44. In this embodiment, again, an air passage 93 serves for conducting atmospheric air into the rear end of the return passage 44.

It will be apparent that the embodiment of the invention illustrated in FIGS. 8 and 9 has certain advantages over the belt-type blade carrier arrangement of FIGS. 1–7, particularly in that it has a smaller overall length and its blades are not subjected to the alternate stretching and relaxation that occurs as the blades of the belt-like carriers pass around drums and then move along the straight stretches. Steering control may be somewhat simplified insofar as the embodiment of FIGS. 8–9 has only a single outlet nozzle 60' instead of the twin outlet nozzles of the FIGS. 1–7 embodiment, and likewise has a single nozzle extension (not shown) of known type, for braking and rearward propulsion. With drum-like blade carriers the flow path of the pumped water necessarily curves along at least a part of its length, whereas with belt-like blade carriers that flow path can be straight along a major portion of its length. However, curvature of the flow path need not necessarily involve lower efficiency, especially if the flow passages are properly designed. The principle disadvantage of the drum-like blade carriers, as compared to the belt-like blade carriers, is that they provide substantially shorter acceleration channels and thus cannot impart as much rearward acceleration to the pumped water, at least under some conditions.

Figure 14:
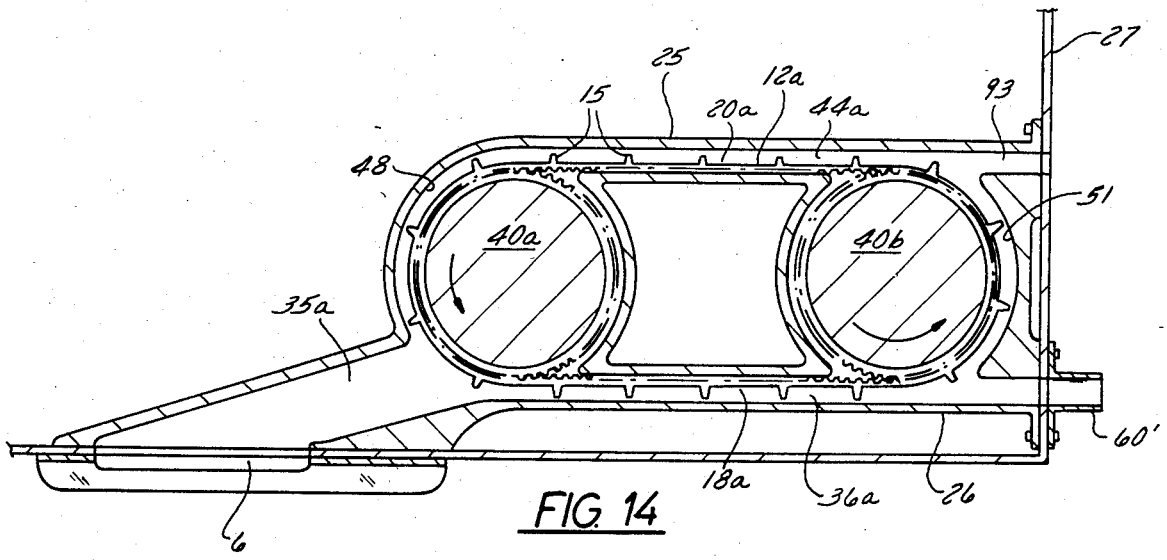
FIG. 14 is a view in vertical section through another modified embodiment of the invention.

The embodiment of the invention illustrated in FIG. 14 resembles that of FIGS. 1–6 in that the impeller means comprises a belt-like blade carrier trained around front and rear drums **40*a*, 40*b*, one of which is power driven; but in this case the unit has only one blade carrier 12*a* and the drums 40*a*, 40*b* rotate on horizontal axes. Thus the driving portion 18*a* of the blade carrier orbit is at its bottom and the return portion 20*a* is at its top. The blades 15 are arranged and configured as in any one of the above described embodiments. The housing again cooperates with the driving portion 18*a* of the blade carrier to define an acceleration channel 36*a* and with the return portion 20*a* to define a return passage 44*a*, as well as defining front and rear transition passages 48 and 51. An inflow passage 35*a* in the housing leads from the intake 6 to a front end portion of the acceleration channel 36*a*, and because of the low level at which the whole of the blade carrier driving portion 18*a* is disposed, this inflow passage can be of more nearly uniform height along its length than the inflow passages of the previously described embodiments and may therefore afford somewhat better conservation of ram energy. The housing also defines an air passage 93 which communicates an air inlet in the transom, above the water line, with the rear end of the return passage 44*a***.

Figure 15:
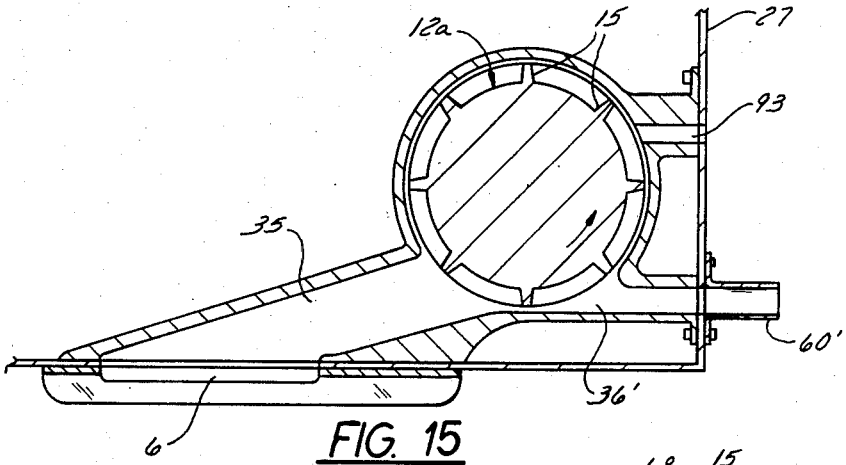
FIG. 15 is a view in vertical section through a further modified embodiment of the invention.
Figure 16:
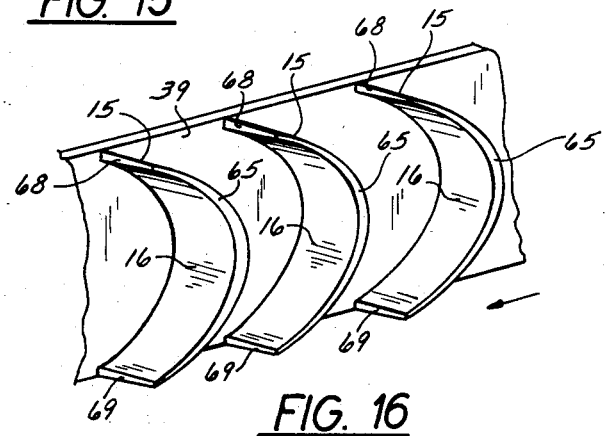
FIG. 16 is a fragmentary perspective view of a short portion of a belt-like blade carrier.

The embodiment of the invention illustrated in FIG. 15 is like that of FIG. 8 and 9 in that the blade carrier **12*a* is in the form of a cylindrical drum which is driven for rotation on a fixed axis and to which blades 15 are directly fixed. However, as with the embodiment of FIG. 14, that of FIG. 15 comprises only one blade carrier, rotating on a horizontal axis. From what has been said of the previously described embodiments, details of the FIG. 15** embodiment will be readily understood without further description.

From the foregoing explanation taken with the accompanying drawings it will be apparent that this invention provides a simple and highly efficient reaction propulsion unit for water craft that has no tendency to develop cavitation and wherein the flow of pumped water is substantially linear and is undisturbed by a drive shaft or the like which is immersed in that flow.

What is claimed as the invention is:

1. A reaction propulsion unit for installation in the interior of a marine craft hull, said unit comprising a housing having forward water intake means into which water can enter through the bottom of the hull, rearwardly discharging outlet means through which water can be discharged to the exterior of the hull, and driven impeller means in said housing whereby water entering said intake means is accelerated rearward and expelled through said outlet means to generate a propulsive reaction force, said propulsion unit being characterized by:

A. said impeller means comprising a blade carrier which moves in an orbit in one orbital direction,
  (1) said blade carrier having thereon a plurality of blades
    (a) which are spaced apart in said orbital direction and
    (b) each of which has a front surface that faces in said orbital direction, and
  (2) the orbit of said blade carrier having
    (a) a driving portion in which the blades move rearward,
    (b) an opposite return portion which is spaced from the driving portion and in which the blades move forward,
    (c) a rear transition portion in which the blades move from said driving portion to said return portion, and
    (d) a front transition portion in which the blades move from said return portion to said driving portion; and B. said housing defining (1) an acceleration channel in which the blade carrier has its driving portion and wherein water is accelerated rearward, said acceleration channel having wall portions extending therealong that lie closely adjacent to the edges of the blades, (2) a return passage in which the blade carrier has its return portion, (3) a front transition passage in which the blade carrier has its front transition portion and which has wall portions extending therealong that lie closely adjacent to the edge of the blades, said front transition passage having opposite ends that communicate, respectively, with a front end of said return passage and with a front end of said acceleration channel, (4) a rear transition passage in which the blade carrier has its rear transition portion and which has wall portions extending therealong that lie closely adjacent to the edges of the blades, said front transition passage having opposite ends that communicate, respectively, with the rear ends of the acceleration channel and of the return passage, (5) substantially rearwardly extending passages communicating (a) said intake means with the front end of said acceleration channel and (b) the rear end of said acceleration channel with said outlet means and cooperating with said acceleration channel to provide an unobstructed path in which water is confined and along which it flows without abrupt acceleration substantially consistently and undivertedly rearwardly from said intake means to said outlet means, and (6) an air inlet passage having an opening to the atmosphere and which is communicated with a rear portion of said return passage to mix air with water in the return passage and thus maintain water in said acceleration channel substantially at a static pressure near that of the atmosphere and prevent cavitation therein.

2. The reaction propulsion unit of claim 1, further characterized by:

(1) said blade carrier having a carrier surface that faces outward from said orbit and has a width substantially parallel to an axis of said orbit; and (2) each said blade (a) having a pair of opposite substantially straight edges that extend substantially normal to said carrier surface and are spaced widthwise of it from one another and (b) having its said front surface extending around a concave curve from one to the other of said edges.

3. The reaction propulsion unit of claim 1 wherein said orbit of the blade carrier has an axis that is substantially vertical, said return portion of the blade carrier is adjacent to a fore-and-aft extending vertical plane of symmetry of the propulsion unit, and said driving portion of the blade carrier is spaced to one side of that plane, further characterized by:

(1) said impeller means comprising a second blade carrier substantially identical to the first-described blade carrier and which (a) has the driving portion of its orbit spaced to the other side of said plane and (b) has the return portion of its orbit adjacent to said plane and in said return passage, wherein its blades are interleaved with those of the first-described blade carrier;

(2) said housing defining a second acceleration channel and second front and rear transition passages in which said second blade carrier has its respective driving and transition portions and which are symmetrical to the first-described acceleration channel and transition passages in relation to said plane; and (3) said housing further defining (a) a second inflow passage which communicates said intake means with the front end of said second acceleration channel and (b) a second outlet passage communicating the rear end of said accelaration channel with said outlet means, said second inflow and outlet passages being symmetrical to the first described inflow and outlet passages in relation to said plane.

4. The reaction propulsion unit of claim 3 wherein said water intake means comprises a single inlet, further characterized by:

flow divider means in said housing, in front of said blade carrier and behind said inlet, whereby water entering said inlet is divided into two substantially equal streams and which cooperates with the housing to define said inflow passages, said inflow passages being in rearwardly divergent relation to one another.

5. The reaction propulsion unit of claim 3 wherein each of said blade carriers is substantially cylindrical, with its axis vertical, and has its blades projecting edgewise substantially radially outwardly.

6. The reaction propulsion unit of claim 5 wherein said discharging outlet means comprises a single outlet nozzle and wherein said outlet passages converge rearwardly towards one another to a junction with one another and with an inlet to said nozzle.

7. The reaction propulsion unit of claim 3, further characterized in that each of said blades on each blade carrier has (1) substantially straight horizontally extending top and bottom edges, both of which are substantially contained in a single vertical plane, (2) an outer tip edge which is straight and vertical as viewed in said orbital direction, and (3) its said front surface concavely curved across its height, as viewed edgewise from its outer tip edge.

8. The reaction propulsion unit of claim 7 wherein each of said blade carriers comprises:

(1) a pair of drums that rotate on vertical axes and are spaced apart in the fore-and-aft direction, and (2) a flat endless blade carrier belt having opposite substantially vertical surfaces from an outer one of which said blades project edgewise outwardly, (a) said carrier belt and blades being formed integrally with one another of an elastomeric material, and (b) said belt being trained around said drums to have a pair of straight stretches, one of which comprises said driving portion and the other of which comprises said return portion.

9. The reaction propulsion unit of claim 8 wherein the rear one of said drums is rotatably driven to move said carrier belt orbitally and the front one of said drums is freely rotatable.

10. The reaction propulsion unit of claim 9, further characterized by:

(1) each of said drums having vertically extending ridges on its cylindrical surface, spaced apart at regular circumferential intervals, and (2) said carrier belt having vertically extending ribs on its inner surface which matingly intermesh with said ridges on the drums to provide a gear-like connection between the drums and the carrier belt.

11. The reaction propulsion unit of claim 7 wherein each said blade, as viewed edgewise from its outer tip edge, has a parabolic curvature across its height.

12. The reaction propulsion unit of claim 7 wherein each said blade, as viewed edgewise from its outer tip edge, has a double curvature across its height, the two curved portions of the blade meeting at a crease-like junction which is contained in a horizontal plane intermediate said top and bottom edges and which projects in said orbital direction.

13. A reaction propulsion unit for a marine craft, said unit comprising a housing having forward water intake means and rearwardly discharging outlet means and wherein water is confined for flow from said intake means to said outlet means, and driven impeller means in said housing whereby water entering said intake means is accelerated rearward and expelled through said outlet means, said propulsion unit being characterized by:

A. said impeller means comprising a blade carrier that carries a plurality of blades for movement in an orbit in one orbital direction, said blades being spaced apart in said orbital direction and each having a front surface that faces substantially in said orbital direction;

B. said housing having wall portions which lie close to the edges of the blades and extend around substantially their entire orbit and which cooperate with the blade carrier to define (1) an acceleration channel along which the blades move rearward in a driving potion of their orbit and (2) a return passage along which the blades move forward in an opposite return portion of their orbit;

C. said housing defining substantially rearwardly extending water passages communicating (1) said intake means with a front end of said acceleration channel and (2) the rear end of said acceleration channel with said outlet means and cooperating with said acceleration channel to confine water to flow substantially consistently and undivertedly rearwardly and without abrupt acceleration from said intake means to said outlet means; and D. said housing further defining an air inlet passage that has an opening to the atmosphere and is communicated with a rear portion of said return passage, for introducing air into the return passage that is carried into the acceleration channel by the orbital movement of the blades and maintains in the acceleration channel a near atmospheric static pressure that prevents cavitation therein.

14. A reaction propulsion unit for a marine craft comprising a housing having forward water intake means and rearward discharging outlet means, and power driven water impeller means in said housing whereby water entering said intake means is accelerated rearward and expelled through said outlet means to generate a propulsive reaction force, said propulsion unit comprising orbitally moving blade carrier means mounted in said housing and defining with said housing rearwardly extending water acceleration channel means for accelerating water rearwardly and out of said outlet means and a return passage connected to opposite ends of said acceleration channel means, said orbitally moving blade carrier means including endless flexible belt means having blades formed on the other surface thereof, power means for rotatably driving said orbitally moving blade carrier means, and an inlet passage connecting a rear portion of said return passage to atmosphere to maintain water therein at a static pressure near atmospheric pressure and prevent cavitation.

15. A propulsion unit as set forth in claim 14 further characterized in that said orbitally moving blade carrier means comprises a pair of flexible endless belts arranged in side-by-side relationship, said endless belts having outer sides which together with said housing define said accelerator channel means and said return passage.

16. A propulsion unit as described in claim 15 further characterized in that said endless belts have curved blades formed on their outer surface.

* * * * *